US010288328B2

(12) United States Patent
Yang et al.

(10) Patent No.: US 10,288,328 B2
(45) Date of Patent: May 14, 2019

(54) OUTDOOR UNIT FOR VRF AIR CONDITIONING SYSTEM AND VRF AIR CONDITIONING SYSTEM HAVING SAME

(71) Applicants: GD MIDEA HEATING & VENTILATING EQUIPMENT CO., LTD., Foshan (CN); MIDEA GROUP CO., LTD., Foshan (CN)

(72) Inventors: Guozhong Yang, Foshan (CN); Rui Song, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 214 days.

(21) Appl. No.: 15/527,867

(22) PCT Filed: Apr. 26, 2016

(86) PCT No.: PCT/CN2016/080244

§ 371 (c)(1),
(2) Date: May 18, 2017

(87) PCT Pub. No.: WO2017/012382

PCT Pub. Date: Jan. 26, 2017

(65) Prior Publication Data

US 2018/0347873 A1 Dec. 6, 2018

(30) Foreign Application Priority Data

Jul. 22, 2015 (CN) ..... 2015 1 0435657

(51) Int. Cl.
*F24F 1/32* (2011.01)
*F24F 3/06* (2006.01)
(Continued)

(52) U.S. Cl.
CPC ..... *F25B 29/003* (2013.01); *F24F 1/32* (2013.01); *F24F 3/065* (2013.01); *F24F 5/00* (2013.01);
(Continued)

(58) Field of Classification Search
CPC ..... F25B 29/003; F25B 2313/02742; F25B 41/046; F25B 41/062; F25B 30/02;
(Continued)

(56) References Cited

U.S. PATENT DOCUMENTS 6,244,057 B1 * 6/2001 Yoshida ..... F25B 13/00 62/160
6,817,205 B1 * 11/2004 Lifson ..... F25B 13/00 62/117
(Continued)

FOREIGN PATENT DOCUMENTS

CN 1469084 A 1/2004
CN 1495390 A 5/2004
(Continued)

OTHER PUBLICATIONS

European Patent Application No. 16827073.4 extended Search and Opinion dated Mar. 21, 2018, 8 pages.
(Continued)

*Primary Examiner* — Kun Kai Ma
(74) *Attorney, Agent, or Firm* — Lathrop Gage LLP

(57) ABSTRACT

An outdoor unit (100) for a VRF air conditioning system and a VRF air conditioning system having the same are provided. The outdoor unit (100) comprises: a compressor (10); a reversing assembly (20); an outdoor heat exchanger (30) comprising an header (31), an heat exchange portion (32), a plurality of flow-distribution capillary tubes (33) and a flow distributor (34); an electronic expansion valve (40) connected to the flow distributor (34); an refrigerant flow path
(Continued)

(50) and an adjusting valve assembly (60), in which the refrigerant flow path (50) is connected to the electronic expansion valve (40), and the adjusting valve assembly (60) is connected to the refrigerant flow path (50) in series; a reversing valve assembly (70) configured to make the refrigerant flow out of the outdoor unit (100) via the second stop valve (120), and make the refrigerant flow into the outdoor unit (100) via the first stop valve (110).

16 Claims, 4 Drawing Sheets

(51) Int. Cl.

| | |
|---|---|
| ***F24F 5/00*** | (2006.01) |
| ***F25B 13/00*** | (2006.01) |
| ***F25B 29/00*** | (2006.01) |
| ***F25B 30/02*** | (2006.01) |
| ***F25B 41/00*** | (2006.01) |
| ***F25B 41/04*** | (2006.01) |
| ***F25B 41/06*** | (2006.01) |

(52) U.S. Cl.
CPC ..... *F25B 13/00* (2013.01); *F25B 30/02* (2013.01); *F25B 41/00* (2013.01); *F25B 41/04* (2013.01); *F25B 41/046* (2013.01); *F25B 41/062* (2013.01); *F25B 2313/027* (2013.01); *F25B 2313/0231* (2013.01); *F25B 2313/02742* (2013.01); *F25B 2400/0403* (2013.01)

(58) Field of Classification Search
CPC .. F25B 1/32; F25B 13/00; F25B 41/04; F25B 2313/027; F25B 2400/0403
See application file for complete search history.

(56) References Cited

U.S. PATENT DOCUMENTS

| | | | | |
|---|---|---|---|---|
| 6,826,921 | B1 | 12/2004 | Uselton | |
| 2003/0230107 | A1* | 12/2003 | Lee | F25B 13/00 62/324.6 |
| 2006/0090487 | A1* | 5/2006 | Park | F25B 13/00 62/160 |
| 2006/0112713 | A1* | 6/2006 | Chang | F25B 13/00 62/324.1 |
| 2008/0197206 | A1* | 8/2008 | Murakami | F25B 13/00 237/2 B |
| 2009/0007589 | A1* | 1/2009 | Takegami | F25B 13/00 62/498 |
| 2009/0206018 | A1* | 8/2009 | Kaneko | B01D 29/114 210/167.32 |
| 2010/0089082 | A1* | 4/2010 | Kawano | F25B 31/004 62/192 |
| 2010/0319376 | A1* | 12/2010 | Kawano | F25B 13/00 62/238.6 |
| 2011/0048054 | A1* | 3/2011 | Sekine | F25B 13/00 62/324.6 |
| 2013/0145785 | A1* | 6/2013 | Nobuhiro | F25B 49/02 62/160 |
| 2013/0167559 | A1* | 7/2013 | Kim | F25B 49/02 62/56 |
| 2013/0180274 | A1* | 7/2013 | Tamaki | F25B 13/00 62/115 |
| 2014/0311172 | A1* | 10/2014 | Iwasaki | F24F 1/06 62/151 |
| 2015/0068241 | A1* | 3/2015 | Sun | F25B 41/04 62/324.6 |
| 2015/0075202 | A1* | 3/2015 | Okuda | F25B 39/00 62/324.4 |
| 2016/0084535 | A1* | 3/2016 | Toya | F25B 5/04 62/175 |
| 2017/0284684 | A1* | 10/2017 | Song | F25B 41/04 |
| 2017/0328614 | A1* | 11/2017 | Yokozeki | F25B 13/00 |

FOREIGN PATENT DOCUMENTS

| | | | |
|---|---|---|---|
| CN | 101144662 | A | 3/2008 |
| CN | 103256748 | A | 8/2013 |
| CN | 105066501 | A | 11/2015 |
| EP | 1371921 | A1 | 12/2003 |
| EP | 2299207 | A2 | 3/2011 |
| EP | 2833086 | A1 | 2/2015 |
| JP | H09126595 | A | 5/1997 |
| JP | 2000146360 | A | 5/2000 |

OTHER PUBLICATIONS

PCT/CN201/6080244 International Search Report and Written Opinion dated Jun. 22, 2016, 13 pages.
PCT/CN201/6080244 English translation of the International Search Report dated Jun. 22, 2016, 2 pages.
European Patent Application No. 16827073.4 Office Action dated Jan. 17, 2019, 4 pages.

* cited by examiner

OUTDOOR UNIT FOR VRF AIR CONDITIONING SYSTEM AND VRF AIR CONDITIONING SYSTEM HAVING SAME

CROSS-REFERENCE TO RELATED APPLICATION

The present application is a national phase entry under 35 USC § 371 of International Application PCT/CN2016/080244, filed Apr. 26, 2016, which claims the benefit of and priority to Chinese Patent Application No. 201510435657.5, filed Jul. 22, 2015, the entire disclosure of which is incorporated herein by reference.

FIELD

The present disclosure relates to a field of air conditioning technologies, and more particularly to an outdoor unit for a VRF air conditioning system and a VRF air conditioning system having the same.

BACKGROUND

With development of air conditioning technology and enhancement of people's environmental protection awareness, a heat recovery VRF (Variable Refrigerant Flow) air conditioning system becomes increasingly popular in the market. A two-tube type heat recovery system in the related art is one of heat recovery VRF air conditioning systems popular in the present market, which consists of three main parts, namely an outdoor unit, a refrigerant flow direction switching device MS and indoor units. According to the difference between cooling starting capacity and heating starting capacity of indoor units, the system has four operation modes as follows: a pure cooling mode where all of the indoor units conduct cooling; a pure heating mode where all of the indoor units conduct heating; a main cooling mode where the indoor units conduct cooling and heating simultaneously, and the cooling starting capacity is greater than the heating starting capacity; a main heating mode where the indoor units conduct cooling and heating simultaneously, and the heating starting capacity is greater than the cooling starting capacity. When the system operates in the main cooling mode, a refrigerant from an outdoor heat exchanger is a gas-liquid two-phase refrigerant, a gaseous refrigerant is used in heating indoor units to conduct heating, and a liquid refrigerant is used in cooling indoor units to conduct cooling. However, an unacceptable pressure drop is produced if the gas-liquid two-phase refrigerant flows through flow-distribution capillary tubes, so that, the actual system adopts, instead of capillary tubes, flute-shaped tubes for flow distribution, but the flute-shaped tubes has a worse flow distributing effect than the capillary tubes, and will result in a worse performance of the heat exchanger.

SUMMARY

The present disclosure seeks to solve at least one of the problems existing in the related art to at least some extent. To this end, the present invention proposes an outdoor unit for a VRF air conditioning system, which has an excellent flow distributing effect, and reduces a pressure drop of a refrigerant when passing through flow-distribution capillary tubes.

The present invention further proposes a VRF air conditioning system having the above-described outdoor unit.

The outdoor unit according to a first aspect of embodiments of the present invention, has a first stop valve and a second stop valve, and includes: a compressor, having an exhaust port and a gas return port; a reversing assembly, having a first valve port, a second valve port, a third valve port and a fourth valve port, in which the first valve port is in communication with one of the second valve port and the third valve port, the fourth valve port is in communication with the other one of the second valve port and the third valve port, the first valve port is connected to the exhaust port, and the fourth valve port is connected to the gas return port; an outdoor heat exchanger, including a header, a heat exchange portion, a plurality of flow-distribution capillary tubes and a flow distributor, in which the heat exchange portion includes a plurality of heat exchange tubes, the header and first ends of the plurality of flow-distribution capillary tubes are connected to two ends of the heat exchange portion respectively, the flow distributor is connected to second ends of the plurality of flow-distribution capillary tubes, and the header is connected to the second valve port; an electronic expansion valve, having a first end connected to the flow distributor; a refrigerant flow path and an adjusting valve assembly, in which a first end of the refrigerant flow path is connected to the second valve port, a second end of the refrigerant flow path is connected to a second end of the electronic expansion valve, the adjusting valve assembly is connected to the refrigerant flow path in series to adjust a flow rate in the refrigerant flow path; a reversing valve assembly connected to the third valve port, the second end of the electronic expansion valve, the first stop valve and the second stop valve respectively, and configured to make the refrigerant flow out of the outdoor unit via the second stop valve, and make the refrigerant flow into the outdoor unit via the first stop valve.

For the outdoor unit according to embodiments of the present invention, by connecting the refrigerant flow path having the adjusting valve assembly to the outdoor heat exchanger and the second end of the electronic expansion valve in parallel, the gaseous refrigerant and the liquid refrigerant may pass through the refrigerant flow path and the outdoor heat exchanger respectively, and then the gaseous refrigerant and the liquid refrigerant are converged into a two-phase refrigerant, which has an excellent flow distributing effect, and not only reduces the pressure drop of the refrigerant when passing through the flow-distribution capillary tubes to ensure the flow rate of the refrigerant of the system, but also meets cooling and heating requirements of outdoor unit at the same time to improve the performance of the outdoor unit.

According to an embodiment of the present invention, the refrigerant flow path includes a plurality of pipelines connected in parallel, and two ends of each pipeline are connected to the electronic expansion valve and the second valve port respectively; the adjusting valve assembly includes a plurality of on-off valves, and the plurality of on-off valves are connected to two pipelines in series respectively.

According to an embodiment of the present invention, a first one-way valve is connected to each pipeline in series, the first one-way valve is opened only in one direction from the second valve port to the electronic expansion valve.

According to an embodiment of the present invention, each on-off valve is a solenoid valve.

According to an embodiment of the present invention, the reversing valve assembly is a first four-way valve, the first four-way valve has four valve ports, and the four valve ports are connected to the third valve port, the second end of the electronic expansion valve, the first stop valve and the second stop valve respectively.

According to an embodiment of the present invention, the reversing valve assembly includes a three-way valve and two one-way valves, the three-way valve has a first port, a second port and a third port, the first port is in communication with one of the second port and the third port, the first port is connected to the second stop valve, the second port is connected to the third valve port, and the third port is connected to the electronic expansion valve; each one-way valve has a circulation end and a stop end, and is opened only in one direction from the circulation end to the stop end, the two one-way valves are configured as a second one-way valve and a third one-way valve, the circulation end of the second one-way valve is connected to the first stop valve, and the stop end thereof is connected between the second port and the third valve port, the circulation end of the third one-way valve is connected to the first stop valve, and the stop end thereof is connected between the third port and the electronic expansion valve.

According to an embodiment of the present invention, the reversing assembly is a second four-way valve.

According to an embodiment of the present invention, further includes a gas-liquid separator having an inlet and a gas outlet, wherein the inlet is connected to the fourth valve port, and the gas outlet is connected to the gas return port.

A VRF air conditioning system according to a second aspect of embodiments of the present invention, includes the outdoor unit according to the above-described embodiments.

REFERENCE NUMERALS

Figure 1:
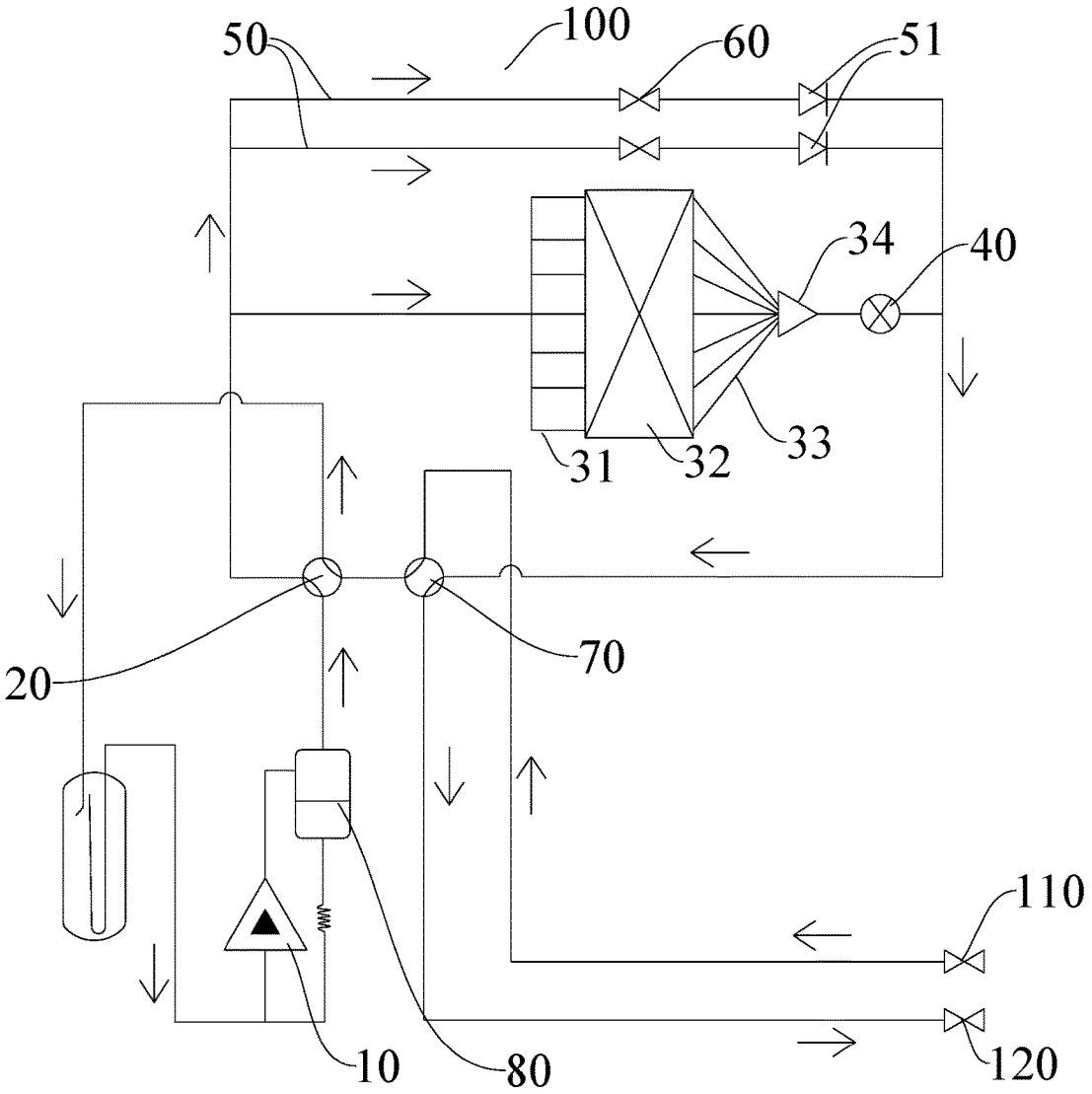
FIG. 1 is a schematic view of a refrigerant flow circuit of an outdoor unit for a VRF air conditioning system according to an embodiment of the present invention, which is in a cooling mode.

100: outdoor unit for VRF air conditioning system; 110: first stop valve; 120: second stop valve;
10: compressor; 11: exhaust port; 12: gas return port;
20: reversing assembly; 21: first valve port; 22: second valve port; 23: third valve port; 24: fourth valve port;
30: outdoor heat exchanger; 31: header; 32: heat exchange portion; 33: flow-distribution capillary tube; 34: flow distributor;
40: electronic expansion valve;
50: refrigerant flow path; 51: first one-way valve;
60: adjusting valve assembly; 61: on-off valve;
70: reversing valve assembly; 71: first four-way valve; 72: three-way valve; 721: first port; 722: second port; 723: third port; 73: second one-way valve; 731 (741): circulation end; 732 (742): stop end; 74: third one-way valve;
80: gas-liquid separator; 81: inlet; 82: gas outlet;

DETAILED DESCRIPTION

Description will be made in detail to embodiments of the present disclosure, and examples of the embodiments will be illustrated in drawings. The embodiments described herein with reference to drawings are explanatory, illustrative, and used to generally understand the present disclosure. The embodiments shall not be construed to limit the present disclosure.

An outdoor unit 100 for a VRF air conditioning system according to a first aspect of embodiments of the present invention will be specifically described below with reference to FIGS. 1 to 4 at first.

The outdoor unit 100 according to embodiments of the present invention, the outdoor unit 100 has a first stop valve 110 and a second stop valve 120.

The outdoor unit 100 for a VRF air conditioning system includes a compressor 10, a reversing assembly 20, an outdoor heat exchanger 30, an electronic expansion valve 40, a refrigerant flow path 50, an adjusting valve assembly 60 and a reversing valve assembly 70. Specifically, the compressor 10 has an exhaust port 11 and a gas return port 12; the reversing assembly 20 has a first valve port 21, a second valve port 22, a third valve port 23 and a fourth valve port 24; the first valve port 21 is in communication with one of the second valve port 22 and the third valve port 23, the fourth valve port 24 is in communication with the other one of the second valve port 22 and the third valve port 23, the first valve port 21 is connected to the exhaust port 11, and the fourth valve port 24 is connected to the gas return port 12; the outdoor heat exchanger 30 includes a header 31, a heat exchange portion 32, a plurality of flow-distribution capillary tubes 33, and a flow distributor 34, and the heat exchange portion 32 includes a plurality of heat exchange tubes; the header 31 and first ends of the plurality of flow-distribution capillary tubes 33 are connected to two ends of the heat exchange portion 32 respectively, the flow distributor 34 is connected to second ends of the plurality of flow-distribution capillary tubes 33, and the header 31 is connected to the second valve port 22.

A first end of the electronic expansion valve 40 is connected to the flow distributor 34, a first end of the refrigerant flow path 50 is connected to the second valve port 22, and a second end of the refrigerant flow path 50 is connected to a second end of the electronic expansion valve 40; an adjusting valve assembly 60 is connected to the refrigerant flow path 50 in series to adjust a flow rate in the refrigerant flow path 50; a reversing valve assembly 70 is connected to the third valve port 23, the second end of the electronic expansion valve 40, the first stop valve 110 and the second stop valve 120 respectively, and the reversing valve assembly 70 is configured to make a refrigerant flow out of the outdoor unit 100 via the second stop valve 120 and flow into the outdoor unit 100 via the first stop valve 110.

In other words, the outdoor unit 100 mainly consists of the compressor 10, the reversing assembly 20, the outdoor heat exchanger 30, the electronic expansion valve 40, the refrigerant flow path 50, the adjusting valve assembly 60 and the reversing valve assembly 70, in which the reversing assembly 20 has the first valve port 21, the second valve port 22, the third valve port 23 and the fourth valve port 24, and when the outdoor unit 100 is in different operation modes, the first valve port 21 may be in communication with the second valve port 22 or the third valve port 23, and the fourth valve port 24 may be in communication with the second valve port 22 or the third valve port 23. Specifically, the compressor 10 has the exhaust port 11 and the gas return port 12, the outdoor heat exchanger 30 mainly consists of the header 31, the plurality of heat exchange tubes (not illustrated), the plurality of flow-distribution capillary tubes 33 and the flow distributor 34; two ends of the plurality of the heat exchange tubes are connected to one end of the header 31 and the first ends of the plurality of flow-distribution capillary tubes 33 respectively, two ends of the flow distributor 34 are connected to the second ends of the plurality of flow-distribution capillary tubes 33 and the first end of the electronic expansion valve 40 respectively, and the other end of the header 31 is in communication with the second valve port 22 of the reversing assembly 20; in addition, the exhaust port 11 of the compressor 10 is in communication with the first valve port 21 of the reversing assembly 20, and the gas return port 12 of the compressor 10 is in communication with the fourth valve port 24 of the reversing assembly 20.

Further, the refrigerant flow path 50 is connected to the header 31 and the second end of the electronic expansion valve 40 in parallel, in which a first end of the refrigerant flow path 50 is in communication with the second valve port 22 of the reversing assembly 20, a second end of the refrigerant flow path 50 is in communication with the second end of the electronic expansion valve 40, and the adjusting valve assembly 60 is provided to the refrigerant flow path 50 and is in communication with the refrigerant flow path 50, that is to say, the adjusting valve assembly 60 is connected to two ends of the header 31 and the electronic expansion valve 40 in parallel to adjust the flow rate in the refrigerant flow path 50. The reversing valve assembly 70 is connected to the third valve port 23 of the reversing assembly 20, the second end of the electronic expansion valve 40, the first stop valve 110 and the second stop valve 120 respectively. When the outdoor unit 100 is in operation, the refrigerant flows into the outdoor unit 100 via the first stop valve 110, and flows out of the outdoor unit 100 via the second stop valve 120.

Specifically, as shown in FIG. 1, in the present embodiment, the first valve port 21 of the reversing assembly 20 is in communication with the second valve port 22 thereof, the third valve port 23 thereof is in communication with the fourth valve port 24 thereof, and when the outdoor unit 100 is in such an operation mode, the refrigerant flows into the outdoor unit 100 via the first stop valve 110; by adjusting the electronic expansion valve 40, a liquid refrigerant from the flow distributor 34 of the outdoor heat exchanger 30 has a degree of undercooling, so as to reduce the pressure drop of the refrigerant generated when passing through the flow-distribution capillary tubes 33; meanwhile, the adjusting valve assembly 60 of the refrigerant flow path 50 is opened to make a gaseous refrigerant from the exhaust port 11 of the compressor 10 flow through the refrigerant flow path 50. Thus, the liquid refrigerant from the second end of the electronic expansion valve 40 and the gaseous refrigerant from the refrigerant flow path 50 are converged, and finally, the refrigerant flows out of the outdoor unit 100 via the second stop valve 120, so as to meet cooling and heating requirements of the outdoor unit 100 at the same time.

Figure 2:
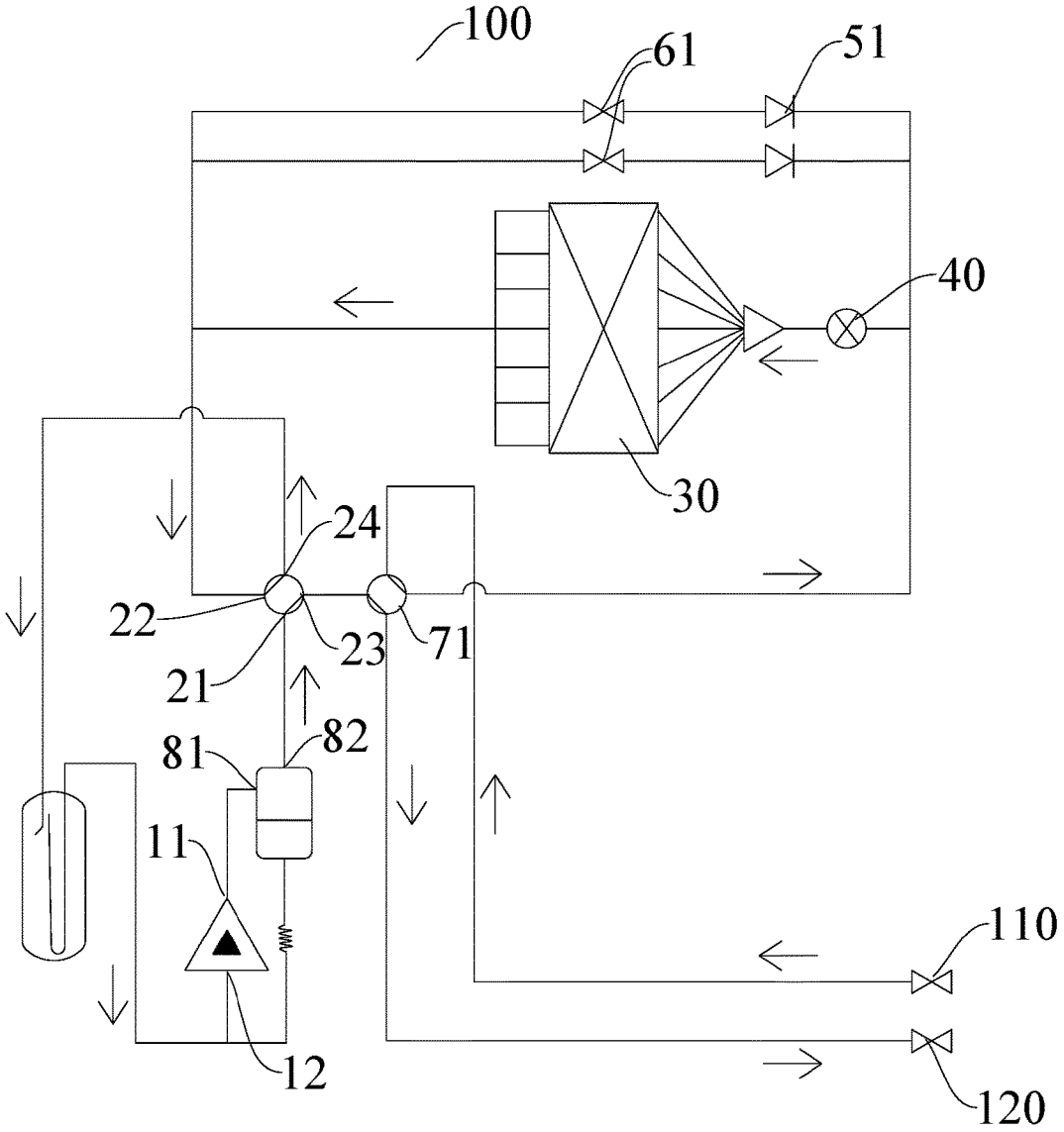
FIG. 2 is a schematic view of a refrigerant flow circuit of an outdoor unit for a VRF air conditioning system according to an embodiment of the present invention, which is in a heating mode.

As shown in FIG. 2, in the present embodiment, the first valve port 21 of the reversing assembly 20 is in communication with the third valve port 23 thereof, the second valve port 22 thereof is in communication with the fourth valve port 24 thereof, and when the outdoor unit 100 is in such an operation mode, by adjusting the electronic expansion valve 40, the refrigerant from the header 31 of the outdoor heat exchanger 30 has a degree of superheat; the flow-distribution capillary tubes 33 may improve the distributing effect of the refrigerant, so as to improve the performance of the outdoor heat exchanger 30.

Thus, for the outdoor unit 100 according to embodiments of the present invention, by connecting the refrigerant flow path 50 having the adjusting valve assembly 60 to the outdoor heat exchanger 30 and the second end of the electronic expansion valve 40 in parallel, the gaseous refrigerant and the liquid refrigerant may flow through the refrigerant flow path 50 and the outdoor heat exchanger 30 respectively, and then the gaseous refrigerant and the liquid refrigerant are converged into a two-phase refrigerant, which has an excellent flow distributing effect, and not only reduces the pressure drop of the refrigerant when passing through the flow-distribution capillary tubes 33 to ensure a flow rate of the refrigerant of the system, but also meets cooling and heating requirements of the outdoor unit 100 at the same time of improving the performance of the outdoor unit 100.

Optionally, according to an embodiment of the present invention, the refrigerant flow path 50 includes a plurality of pipelines connected in parallel, two ends of each pipeline are connected to the electronic expansion valve 40 and the second valve port 22 respectively, the adjusting valve assembly 60 includes a plurality of on-off valves 61, and the plurality of on-off valves 61 are connected to two pipelines in series respectively.

As shown in FIGS. 1 and 2, in the present embodiment, the outdoor heat exchanger 30 is in communication with the first end of the electronic expansion valve 40, and the outdoor heat exchanger 30 is in communication with the second valve port 22 of the reversing assembly 20, and two pipelines are connected in parallel between the second valve port 22 of the reversing assembly 20 and the second end of the electronic expansion valve 40, in which each pipeline is provided with one on-off valve 61, i.e. two ends of each on-off valve 61 are connected to the second valve port 22 of the reversing assembly 20 and the second end of the electronic expansion valve 40 respectively. Thus, the on-off valves 61 may control the opening and closing of the two pipelines, and further control the flow rate of the refrigerant of the refrigerant flow path 50.

Further, a first one-way valve 51 is connected to each pipeline in series, and the first one-way valve 51 may be opened only in one direction from the second valve port 22 to the electronic expansion valve 40.

That is to say, each pipeline is provided with one on-off valve 61 and one first one-way valve 51, in which one end of the first one-way valve 51 is connected to the on-off valve 61, and the other end of the first one-way valve 51 is connected to the second end of the electronic expansion valve 40; the refrigerant of the refrigerant flow path 50 may only flow from the second valve port 22 of the reversing assembly 20 to the second end of the electronic expansion valve 40, passing through the on-off valve 61 and the first one-way valve 51 successively, but may not flow in the opposite direction.

Specifically, as shown in FIG. 2, when the outdoor unit 100 is in such an operation mode, the refrigerant flows into the outdoor unit 100 via the first stop valve 110, and by adjusting the electronic expansion valve 40, the refrigerant may only flow through the electronic expansion valve 40 and the outdoor heat exchanger 30 successively before finally flowing out of the outdoor unit 100 via the second stop valve 120. Thus, the refrigerant from the header 31 of the outdoor heat exchanger 30 has the degree of superheat, and the flow-distribution capillary tubes 33 may improve the distributing effect of the refrigerant, so as to improve the performance of the outdoor heat exchanger 30.

Preferably, according to an embodiment of the present invention, each on-off valve 61 is a solenoid valve. Two ends of the solenoid valve are connected to the second valve port 22 and the first one-way valve 51 respectively, and the solenoid valve may achieve automatic control over the system, which reduces the pressure drop of the refrigerant when passing through the flow-distribution capillary tubes 33 of the outdoor heat exchanger 30, ensures pressure requirement of the system's refrigerant, and improves the performance of the outdoor unit 100.

As shown in FIGS. 1 and 2, in some specific embodiments of the present invention, the reversing valve assembly 70 is a first four-way valve 71, the first four-way valve 71 has four valve ports, and the four valve ports are connected to the third valve port 23, the second end of the electronic expansion valve 40, the first stop valve 110 and the second stop valve 120 respectively.

In other words, the reversing valve assembly 70 is formed as the first four-way valve 71, the four valve ports of the first four-way valve 71 are connected to the third valve port 23 of the reversing assembly 20, the second end of the electronic expansion valve 40, the first stop valve 110 and the second stop valve 120 respectively. Specifically, as shown in FIG. 1, in the present embodiment, when the outdoor unit 100 is in such an operation mode, the first stop valve 110 is in communication with the third valve port 23 via the first four-way valve 71, and the second stop valve 120 is in communication with the second end of the electronic expansion valve 40 via the first four-way valve 71, but as shown in FIG. 2, in the present embodiment, when the outdoor unit 100 is in such an operation mode, the first stop valve 110 is in communication with the second end of the electronic expansion valve 40 via the first four-way valve 71, and the second stop valve 120 is in communication with the third valve port 23 via the first four-way valve 71.

In other specific embodiments of the present invention, the reversing valve assembly 70 includes a three-way valve 72 and two one-way valves; the three-way valve 72 has a first port 721, a second port 722 and a third port 723; the first port 721 is in communication with one of the second port 722 and the third port 723, the first port 721 is connected to the second stop valve 120, the second port 722 is connected to the third valve port 23, and the third port 723 is connected to the electronic expansion valve 40; each one-way valve has a circulation end 731 (741) and a stop end 732 (742), and the one-way valve may be opened only in one direction from the circulation end 731 (741) to the stop end 732 (742); the two one-way valves are configured as a second one-way valve 73 and a third one-way valve 74, the circulation end 731 of the second one-way valve 73 is connected to the first stop valve 110 and the stop end 732 thereof is connected between the second port 722 and the third valve port 23, and the circulation end 741 of the third one-way valve 74 is connected to the first stop valve 110 and the stop end 742 thereof is connected between the third port 723 and the electronic expansion valve 40.

Figure 3:
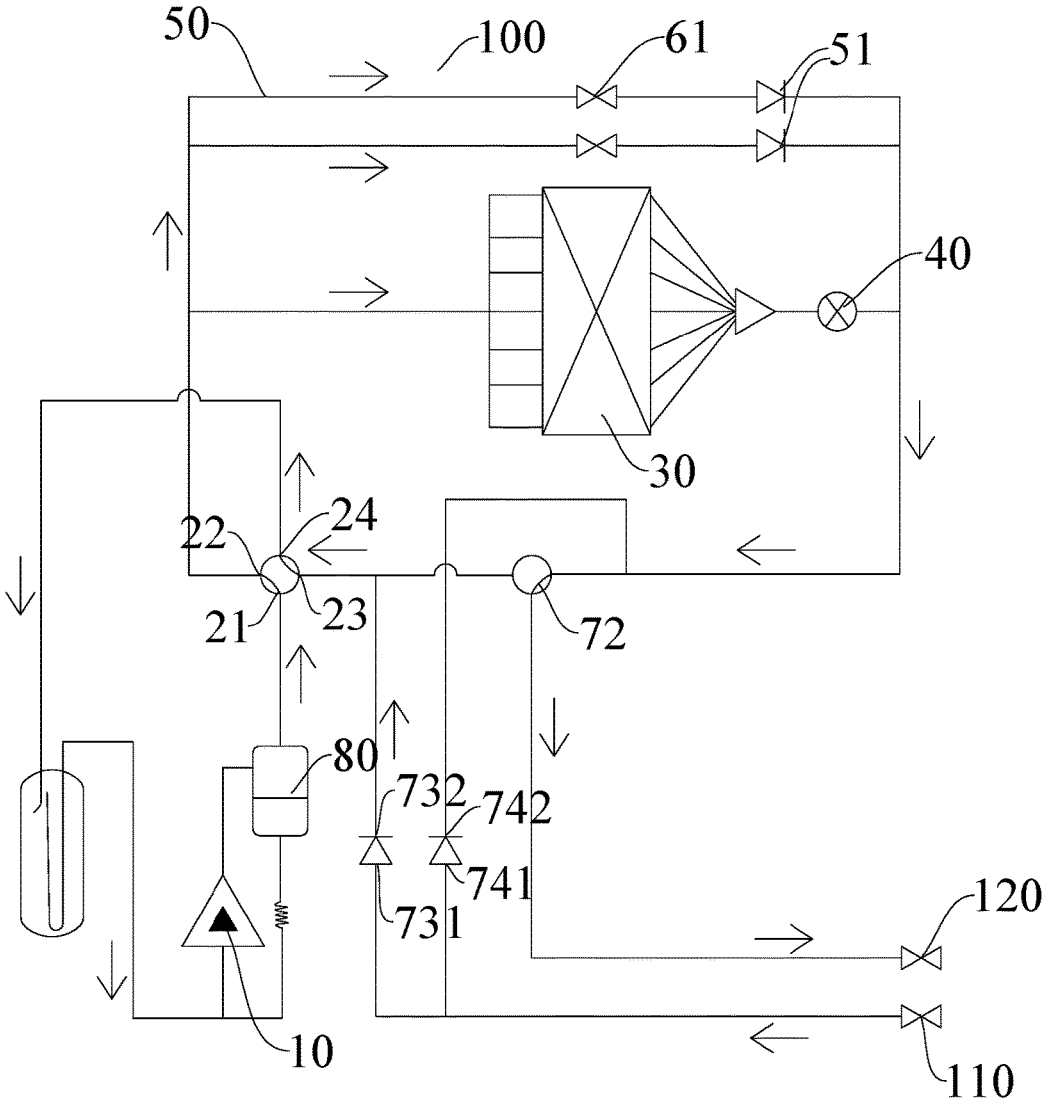
FIG. 3 is a schematic view of a refrigerant flow circuit of an outdoor unit for a VRF air conditioning system according to another embodiment of the present invention, which is in a cooling mode.
Figure 4:
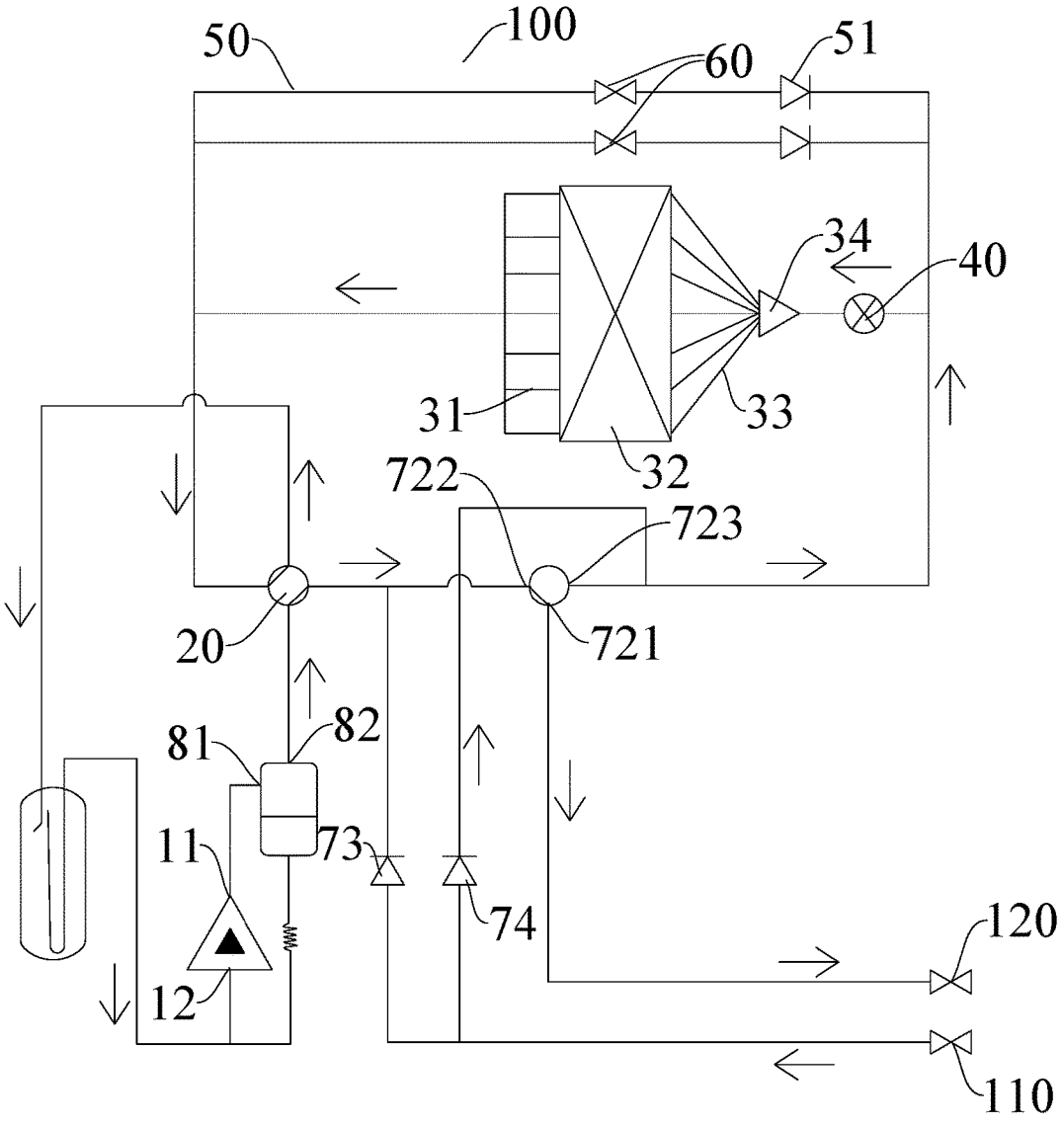
FIG. 4 is a schematic view of a refrigerant flow circuit of an outdoor unit for a VRF air conditioning system according to another embodiment of the present invention, which is in a heating mode.

Specifically, as shown in FIGS. 3 and 4, in the present embodiment, the reversing valve assembly 70 mainly consists of the three-way valve 72, the second one-way valve 73 and the third one-way valve 74, in which the three-way valve 72 has the first port 721, the second port 722 and the third port 723, the first port 721 of the three-way valve 72 is connected to the second stop valve 120, the second port 722 is connected to the third valve port 23, and the third port 723 is connected to the second end of the electronic expansion valve 40; two ends of the second one-way valve 73 are connected to the first stop valve 110 and the third valve port 23 respectively; and two ends of the third one-way valve 74 are connected to the first stop valve 110 and the second end of the electronic expansion valve 40 respectively.

As shown in FIG. 3, in the present embodiment, when the outdoor unit 100 is in such an operation mode, the first port 721 of the three-way valve 72 is in communication with the third port 723, the refrigerant flows from the first stop valve 110 into the outdoor unit 100 via the second one-way valve 73, and the gas-liquid two-phase refrigerant from the second end of the electronic expansion valve 40 and the first one-way valve 51 flows out of the outdoor unit 100 from the second stop valve 120 through the three-way valve 72. As shown in FIG. 4, in the present embodiment, when the outdoor unit 100 is in such an operation mode, the first port 721 of the three-way valve 72 is in communication with the second port 722, the refrigerant flows from the first stop valve 110 into the outdoor unit 100 via the third one-way valve 74, and the refrigerant from the header 31 of the outdoor heat exchanger 30 may only flow out of the outdoor unit 100 from the second stop valve 120 through the three-way valve 72.

Thus, by configuring the reversing valve assembly 70 as the first four-way valve 71 or a combination of the three-way valve 72 and two one-way valves, the direction reversing, and circulation or stop of the refrigerant flow may be achieved to make the system switch between the cooling mode and the heating mode, which meets functional requirements of the system, and ensures a normal operation of the outdoor unit 100 in different operation modes.

Preferably, according to an embodiment of the present invention, the reversing assembly 20 is a second four-way valve. In other words, the second four-way valve has the first valve port 21, the second valve port 22, the third valve port 23 and the fourth valve port 24; when the outdoor unit 100 is in different operation modes, the first valve port 21 of the second four-way valve may be in communication with the second valve port 22 thereof or the third valve port 23 thereof, and the fourth valve port 24 may be in communication with the second valve port 22 thereof or the third valve port 23 thereof. The second four-way valve has a simple structure, which may avoid connections of additional components and pipes, improve the assembling efficiency of the outdoor unit 100, and reduce the cost of the outdoor unit 100.

In addition, according to an embodiment of the present invention, a gas-liquid separator 80 is also provided. The gas-liquid separator 80 includes an inlet 81 and a gas outlet 82, the inlet 81 is connected to the fourth valve port 24, and the gas outlet 82 is connected to the gas return port 12.

That is to say, the outdoor unit 100 mainly consists of the compressor 10, the reversing assembly 20, the outdoor heat exchanger 30, the electronic expansion valve 40, the refrigerant flow path 50, the adjusting valve assembly 60, the reversing valve assembly 70 and the gas-liquid separator 80. The gas-liquid separator 80 has the inlet 81 and the gas outlet 82, the inlet 81 of the gas-liquid separator 80 is in communication with the fourth valve port 24, and the compressor 10 is provided between the inlet 81 of the gas-liquid separator 80 and the fourth valve port 24 and is in communication with the inlet 81 of the gas-liquid separator 80 and the fourth valve port 24 respectively. As shown in FIG. 2, in the present embodiment, the gas outlet 82 of the gas-liquid separator 80 is in communication with the gas return port 12 of the compressor 10.

Specifically, as shown in FIGS. 1 and 3, the outdoor unit 100 is in the cooling (main cooling) mode, the refrigerant enters the outdoor unit 100 via the first stop valve 110; by adjusting the electronic expansion valve 40, the liquid refrigerant from the flow distributor 34 of the outdoor heat exchanger 30 has the degree of subcool, so as to reduce the pressure drop of the refrigerant generated when passing through the flow-distribution capillary tubes 33; meanwhile, the on-off valve 61 of the refrigerant flow path 50 is opened to make the gaseous refrigerant from the exhaust port 11 of the compressor 10 flow through the refrigerant flow path 50. Thus, the liquid refrigerant from the second end of the electronic expansion valve 40 and the gaseous refrigerant from the refrigerant flow path 50 are converged, and finally, the refrigerant flows out of the outdoor unit 100 via the second stop valve 120, so as to meet cooling and heating requirements of the outdoor unit 100 at the same time.

As shown in FIGS. 2 and 4, the outdoor unit 100 is in the heating (main heating) mode, the refrigerant enters the outdoor unit 100 via the first stop valve 110; by adjusting the electronic expansion valve 40, the refrigerant from the header 31 of the outdoor heat exchanger 30 has the degree of superheat; since the first one-way valve 51 of the refrigerant flow path 50 is opened only in one direction, in this mode, the refrigerant may only flow through the outdoor heat exchanger 30; the flow-distribution capillary tubes 33 of the outdoor heat exchanger 30 may improve the distributing effect of the refrigerant, and improve the performance of the outdoor heat exchanger 30.

A VRF air conditioning system according to a second aspect of embodiments of the present invention, includes the outdoor unit 100 according to above-described embodiments. Since the outdoor unit 100 according to embodiments of the present invention has the above-described technical effect, the VRF air conditioning system according to embodiments of the present application also has the above-described technical effect. That is, the VRF air conditioning system has a good flow distributing effect, and may also reduce the pressure drop of the refrigerant when passing through the flow-distribution capillary tubes 33, which ensures enough flow rate of the refrigerant of the system, meets cooling and heating requirements of outdoor unit 100 at the same time, and improve the performance of the VRF air conditioning system.

Other constitutions and operations of the VRF air conditioning system according to embodiments of the present invention are well known by those skilled in the art, and will not described in detail herein.

In the specification of the present disclosure, it should be understood that the terms such as "central", "longitudinal", "lateral", "length", "width", "thickness", "upper", "lower", "front", "rear", "left", "right", "vertical", "horizontal", "top", "bottom", "inner", "outer", "clockwise", "counterclockwise", "axial", "radial", "circumferential", etc. should be construed to refer to the orientation as then described or as shown in the drawings under discussion. These relative terms are for convenience and simplifying of description, and do not alone indicate or imply that the device or element referred to must have a particular orientation, or be constructed or operated in a particular orientation. Therefore, these relative terms should not be construed to limit the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications or interactions of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature. Reference throughout this specification to "an embodiment," "some embodiments," "an example," "a specific example," or "some examples," device that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art can combine the different embodiments or examples and the features of the different embodiments or examples described in this specification without conflicting situations.

Although explanatory embodiments have been shown and described, it would be appreciated that the above embodiments cannot be construed to limit the present disclosure, and changes, alternatives, and modifications can be made in the embodiments within the scope of the present disclosure by those skilled in the art.

What is claimed is:

1. An outdoor unit for a Variable Refrigerant Flow (VRF) air conditioning system, having a first stop valve and a second stop valve and comprising:

a compressor, having an exhaust port and gas return port;

a reversing assembly, having a first valve port, a second valve port, a third valve port and a fourth valve port, the first valve port being in communication with one of the second valve port and the third valve port, the fourth valve port being in communication with the other one of the second valve port and the third valve port, the first valve port being connected to the exhaust port, and the fourth valve port being connected to the gas return port;

an outdoor heat exchanger, comprising a header, a heat exchange portion, a plurality of flow-distribution capillary tubes and a flow distributor, the heat exchange portion comprising a plurality of heat exchange tubes, the header and first ends of the plurality of flow-distribution capillary tubes being connected to two ends of the heat exchange portion respectively, the flow distributor being connected to second ends of the plurality of flow-distribution capillary tubes, and the header being connected to the second valve port;

an electronic expansion valve, having a first end connected to the flow distributor;

a refrigerant flow path and an adjusting valve assembly, a first end of the refrigerant flow path being connected to the second valve port, a second end of the refrigerant flow path being connected to a second end of the electronic expansion valve, the adjusting valve assembly being connected to the refrigerant flow path in series to adjust a flow rate in the refrigerant flow path;

a reversing valve assembly, connected to the third valve port, the second end of the electronic expansion valve, the first stop valve and the second stop valve respectively, and configured to make the refrigerant flow out of the outdoor unit via the second stop valve, and make the refrigerant flow into the outdoor unit via the first stop valve.

2. The outdoor unit according to claim 1, wherein the refrigerant flow path comprises a plurality of pipelines connected in parallel, and two ends of each pipeline are connected to the electronic expansion valve and the second valve port respectively; the adjusting valve assembly comprises a plurality of on-off valves, and the plurality of on-off valves are connected to the plurality of pipelines respectively.

3. The outdoor unit according to claim 2, wherein a first one-way valve is connected to one of the plurality of pipelines, and the first one-way valve is opened only in one direction from the second valve port to the electronic expansion valve.

4. The outdoor unit according to claim 2, wherein each one of the plurality of on-off valves is a solenoid valve.

5. The outdoor unit according to claim 1, wherein the reversing valve assembly is a first four-way valve, the first four-way valve has four valve ports, and the four valve ports are connected to the third valve port of the reversing assembly, the second end of the electronic expansion valve, the first stop valve and the second stop valve respectively.

6. The outdoor unit according to claim 1, wherein the reversing valve assembly comprises a three-way valve and two one-way valves, the three-way valve has a first port, a second port and a third port, the first port is in communication with one of the second port and the third port, the first port is connected to the second stop valve, the second port is connected to the third valve port of the reversing assembly, and the third port of the three-way valve is connected to the electronic expansion valve;

each one of the two one-way valve has a circulation end and a stop end, and is opened only in one direction from the circulation end to the stop end, the two one-way valves are configured as a second one-way valve and a third one-way valve, the circulation end of the second one-way valve is connected to the first stop valve, and the stop end of the second one-way valve is connected between the second port of the three-way valve and the third valve port of the reversing assembly, the circulation end of the third one-way valve is connected to the first stop valve, and the stop end of the third one-way valve is connected between the third port of the three-way valve and the electronic expansion valve.

7. The outdoor unit according to claim 1, wherein the reversing assembly is a second four-way valve.

8. The outdoor unit according to claim 1, further comprising:

a gas-liquid separator, having an inlet and a gas outlet, wherein the inlet is connected to the fourth valve port, and the gas outlet is connected to the gas return port.

9. A Variable Refrigerant Flow (VRF) air conditioning system, comprising:

an outdoor unit for the VRF air conditioning system, having a first stop valve and a second stop valve and comprising:

a compressor, having an exhaust port and gas return port;

a reversing assembly, having a first valve port, a second valve port, a third valve port and a fourth valve port, the first valve port being in communication with one of the second valve port and the third valve port, the fourth valve port being in communication with the other one of the second valve port and the third valve port, the first valve port being connected to the exhaust port, and the fourth valve port being connected to the gas return port;

an outdoor heat exchanger, comprising a header, a heat exchange portion, a plurality of flow-distribution capillary tubes and a flow distributor, the heat exchange portion comprising a plurality of heat exchange tubes, the header and first ends of the plurality of flow-distribution capillary tubes being connected to two ends of the heat exchange portion respectively, the flow distributor being connected to second ends of the plurality of flow-distribution capillary tubes, and the header being connected to the second valve port;

an electronic expansion valve, having a first end connected to the flow distributor;

a refrigerant flow path and an adjusting valve assembly, a first end of the refrigerant flow path being connected to the second valve port, a second end of the refrigerant flow path being connected to a second end of the electronic expansion valve, the adjusting valve assembly being connected to the refrigerant flow path in series to adjust a flow rate in the refrigerant flow path;

a reversing valve assembly, connected to the third valve port, the second end of the electronic expansion valve, the first stop valve and the second stop valve respectively, and configured to make the refrigerant flow out of the outdoor unit via the second stop valve, and make the refrigerant flow into the outdoor unit via the first stop valve.

10. The VRF air conditioning system according to claim 9, wherein the refrigerant flow path comprises a plurality of pipelines connected in parallel, and two ends of each of the plurality of pipelines are connected to the electronic expansion valve and the second valve port respectively; the adjusting valve assembly comprises a plurality of on-off valves, and the plurality of on-off valves are connected to the plurality of pipelines respectively.

11. The VRF air conditioning system according to claim 10, wherein a first one-way valve is connected to one of the plurality of pipelines, and the first one-way valve is opened only in one direction from the second valve port of the reversing assembly to the electronic expansion valve.

12. The VRF air conditioning system according to claim 10, wherein each one of the plurality of on-off valves is a solenoid valve.

13. The VRF air conditioning system according to claim 9, wherein the reversing valve assembly is a first four-way valve, the first four-way valve has four valve ports, and the four valve ports are connected to the third valve port of the reversing assembly, the second end of the electronic expansion valve, the first stop valve and the second stop valve respectively.

14. The VRF air conditioning system according to claim 9, wherein the reversing valve assembly comprises a three-way valve and two one-way valves, the three-way valve has a first port, a second port and a third port, the first port is in communication with one of the second port and the third port, the first port is connected to the second stop valve, the second port is connected to the third valve port of the reversing assembly, and the third port of the three-way valve is connected to the electronic expansion valve;

each one of the two one-way valves has a circulation end and a stop end, and is opened only in one direction from the circulation end to the stop end, the two one-way valves are configured as a second one-way valve and a third one-way valve, the circulation end of the second one-way valve is connected to the first stop valve, and the stop end of the second one-way valve is connected between the second port of the three-way valve and the third valve port, the circulation end of the third one-way valve is connected to the first stop valve, and the stop end of the third one-way valve is connected between the third port of the three-way valve and the electronic expansion valve.

15. The VRF air conditioning system according to claim 9, wherein the reversing assembly is a second four-way valve.

16. The VRF air conditioning system according to claim 9, further comprising:

a gas-liquid separator, having an inlet and a gas outlet, wherein the inlet is connected to the fourth valve port, and the gas outlet is connected to the gas return port.

* * * * *